US005417396A

United States Patent [19]

Merl

[11] Patent Number: 5,417,396

[45] Date of Patent: May 23, 1995

[54] UNIVERSAL UPRIGHT INTERFACE BRACKET

[76] Inventor: Milton J. Merl, 50 Wilcox Rd., Stonington, Conn. 06830

[21] Appl. No.: 140,605

[22] Filed: Oct. 21, 1993

[51] Int. Cl.[6] ..... E04G 5/06

[52] U.S. Cl. ..... 248/222.1; 108/108; 248/227

[58] Field of Search ..... 248/222.1, 220.2, 222.2, 248/223.4, 224.4, 223.3, 225.2, 227, 231.9, 235, 243; 108/108

[56] References Cited

U.S. PATENT DOCUMENTS 4,460,147 7/1984 Macbain ..... 248/243 X
4,895,331 1/1990 Nehls ..... 248/235 X
5,118,060 6/1992 Sproken ..... 248/222.1 X
5,188,326 2/1993 Zich ..... 248/222.1 X

*Primary Examiner*—Ramon O. Ramirez
*Attorney, Agent, or Firm*—Schweitzer Cornman & Gross

[57] ABSTRACT

A universal shelf bracket composed of three basic interlocking components held together and adjusted by a screw and rectangular nut. The bracket engages a pair of vertically aligned slots in a vertical wall and can be adjusted to fit a variety of slot spacings and depths. The bracket is constructed so that its tabs are both flush with the same outer wall while still allowing the bracket to fit squarely in the slots. Left and right brackets can be constructed so that two brackets can be engaged to one common pair of vertically aligned slots.

16 Claims, 5 Drawing Sheets

UNIVERSAL UPRIGHT INTERFACE BRACKET

BACKGROUND OF THE INVENTION

1. FIELD OF THE INVENTION

This invention relates to a bracket that hooks into store uprights and more particularly a universal upright interface bracket used to support a variety of different shelving. signs, peg hooks, and other various point-of-sale elements in display case uprights.

2. DESCRIPTION OF THE RELATED ART

Upright interface brackets are used in standard store gondola, dairy case, and frozen food display case uprights. Uprights from different manufacturers have different slot configurations into which shelving is affixed by means of different sized brackets. This is due to proprietary and evolutionary design processes, as well as varying design trends, which have been introduced to meet customer requirements for hook prices and functions.

A continuing and strong need exists to vastly improve the functionality of standard store shelving. This is being driven by the desire to increase shelf space utilization, to alter existing spaces to handle new and different packaging, and to embellish sections of shelf space, setting them apart from other areas of the store, all while maintaining efficiency and cost effectiveness. Because of this need, upgrade and retrofit point-of-sale programs are growing in importance and, as a result, many different types of display cases, each with its own slot configuration, must be used together. This causes an obvious problem, namely the need to keep many different shelf brackets in stock. This is both financially and temporally inefficient.

SUMMARY OF THE INVENTION

This problem is solved by the use of a universal upright interface bracket which can be fitted to the wide variety of differing slot configurations present in a given store. The invention is composed of three interlocking components—a fixed bracket member, a sliding bracket member, and a sliding shim—held together by a locking assembly. The fixed and sliding bracket members each have a vertical tab which are vertically aligned when the brackets are fitted together. The tabs interface with slots in a slotted vertical wall. The sliding bracket member can be adjusted vertically with respect to the fixed bracket member along a guide. This allows the bracket to accommodate shelving standards with a variety of slot spacings. The sliding shim fits between the fixed and sliding bracket members and can be adjusted horizontally along guides in the fixed bracket member. This allows the sliding bracket to be snugly fitted into a wide variety of slot depths.

The locking assembly, composed of a screw and rectangular nut, has a dual purpose. The nut is fitted into the fixed and sliding bracket members to prevent the sliding bracket member from sliding so far as to disengage from the fixed bracket member. The screw is passed through the nut and used to fix the position of the sliding shim against the outer wall of the slot.

The tabs and guides of the fixed and sliding bracket members are offset from their respective bodies so that the vertically aligned tabs are flush with one wall of the assembled bracket while still allowing the bracket to fit squarely in the slots. Because of this asymmetry, left and right oriented brackets can be made so that they fit in one common pair of vertically aligned slots.

Because the components of the bracket interlock easily, they can be integrated before assembly into other elements of a point-of-sale unit such as a shelf or peg bar prior to painting, plating, etcetera. For example, one of the bracket members could be welded to a shelf bottom and painted. Then, after finishing, the bracket can be assembled.

OBJECTS AND ADVANTAGES

A primary object of the invention is to meet the need for a single upright display bracket which can be used with the wide variety of slot configurations present in current store display uprights.

Another object of the present invention is to provide an improved bracket which will eliminate the need to stock many different bracket types, thereby lowering storage costs.

A further object of the present invention is to provide an improved bracket which is simple to fabricate and easy to assemble allowing integration with other display components before assembly.

Yet another object of the present invention is to provide an improved bracket in which the tabs are offset from the body of the bracket so as to be flush with one of its sides, allowing left and right brackets to be used side by side in a single pair of vertically aligned slots.

Other objects, features, and advantages will become apparent to those skilled in the art upon careful consideration of the following detailed description of a preferred embodiment of the invention.

Figure 2:
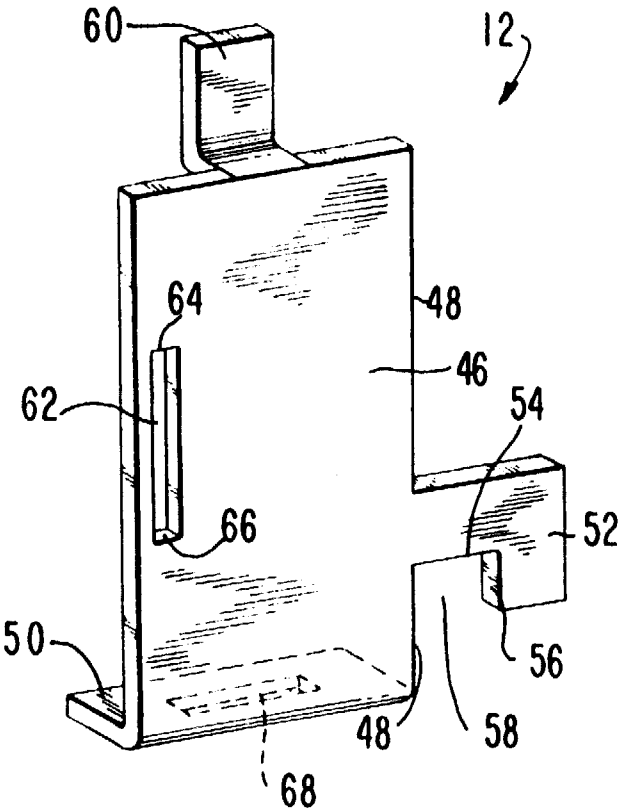
FIG. 2 is a right side perspective view of a sliding bracket member.
Figure 1:
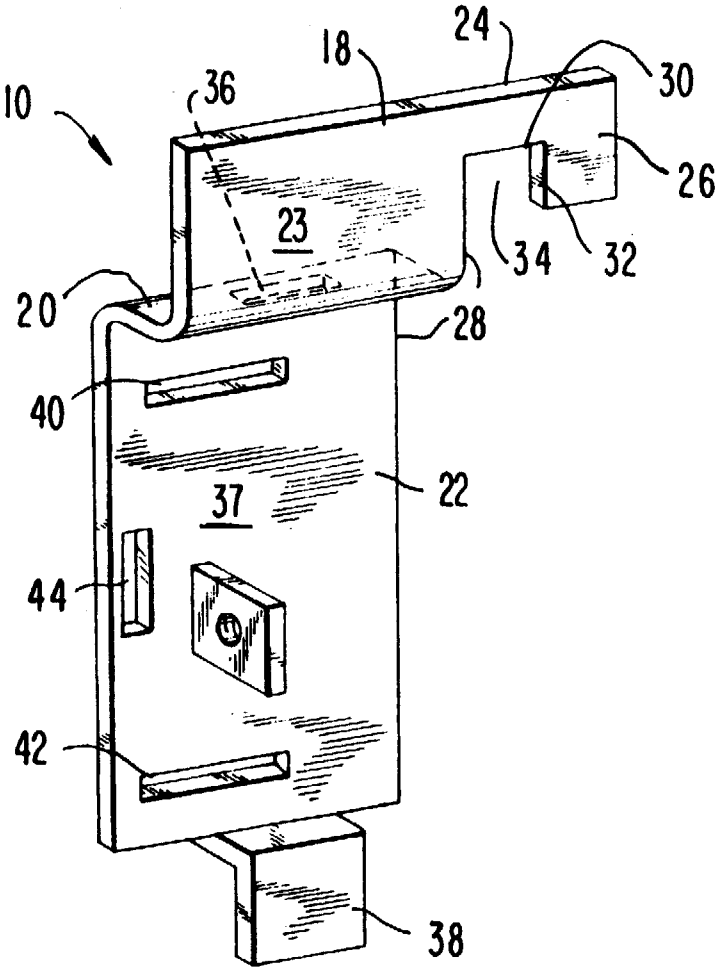
FIG. 1 is a right side perspective view of a fixed bracket member.
Figure 4:
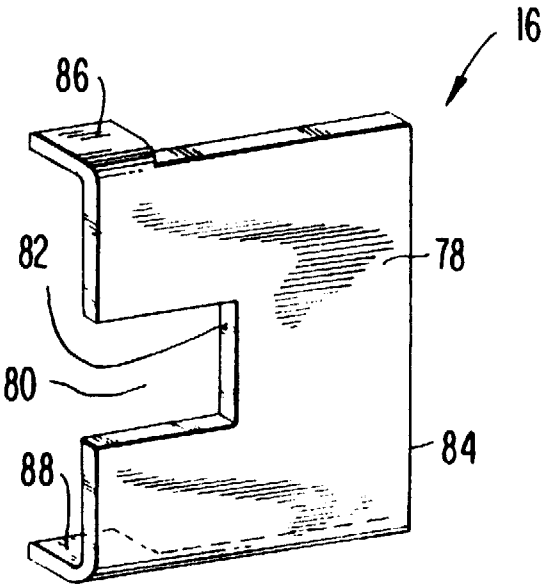
FIG. 4 is a right side perspective view of the sliding shim.
Figure 3:
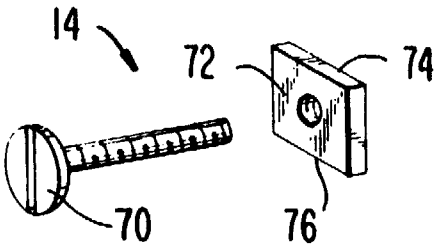
FIG. 3 is a right side perspective exploded view of the locking assembly.

FIG. **6*a*** is a front view of a fully assembled bracket; and

FIG. **6*b*** is a right side elevational view of the assembled bracket with parts shown in phantom and engaging a pair of vertical slots in an upright wall shown in perspective and in cross-section.

DESCRIPTION OF THE PREFERRED EMBODIMENT

Turning to the drawings and in particular FIGS. 1 through 4, the universal upright interface bracket consists of 4 basic components: a fixed bracket member 10, a sliding bracket member 12, a locking assembly 14 and a sliding shim 16. A right handed upright bracket will be described.

The fixed bracket member 10 (FIG. 1) has three distinct regions: an upper vertical portion 18, a middle horizontal portion 20, and a lower vertical portion 22. The three regions may be formed from a single piece where the upper and lower vertical portions lie in parallel planes and are connected by and are substantially perpendicular to the middle horizontal portion. The upper vertical portion is composed of a rectangular body 23 with a top surface 24, and having a tab 26 extending rearwardly and downwardly. A downwardly opening channel 34 is defined by the fixed bracket vertical back surface 28, the fixed bracket tab inner horizontal surface 30, and the fixed bracket tab inner vertical surface 32.

The middle horizontal portion 20 shares back surface 28 with the upper and lower vertical portions and has a centrally located finger slot 36 running from front to back. The lower vertical portion 22 consists of a rectangular body 37 with the back surface 28. It has a finger portion 38 at its bottom bent outward to the right and then downwards forming an angle-iron type construct. At the top and bottom of the rectangular body 37 are upper and lower horizontal guides 40, 42 running from front to back. There is also a forwardly, centrally located vertical slot 44.

The sliding bracket member 12 (FIG. 2) is composed of a vertical rectangular body 46 having a vertical back surface 48. It is bent at the bottom to form a horizontal foot portion 50 extending perpendicularly to the left. Extending rearwardly and downwardly from the back of the middle of the rectangular body is a tab portion 52 having an inner horizontal surface 54 and an inner vertical surface 56. A downwardly opening channel 58 is defined by the vertical back surface 48, the tab inner horizontal surface 54, and the tab inner vertical surface 56. At the top of the rectangular body is a finger portion 60 bent outward to the left and then upwards forming an angle-iron type construct. In the middle of the rectangular body is a forwardly, centrally located vertical guide 62 with upper and lower inner surfaces 64, 66. In the foot portion is a centrally located finger slot 68 running from front to back.

The locking assembly 14 (FIG. 3) is composed of a screw 70 and a rectangular nut 72 with an upper surface 74 and a lower surface 76. The height and width of the fixed bracket vertical slot 44 (FIGS. 1, 5) should be just larger than the height and depth of the nut so when the nut is inserted in the slot it fits snugly. The width of the sliding bracket vertical guide 62 (FIGS. 2, 5) should be just wider than the depth of the nut. The height of the slot should be significantly more than that of the nut so when the nut is inserted into the guide, it can be freely moved vertically along the length of the guide with minimal front to back movement.

The sliding shim 16 (FIG. 4) is a vertical body 78 having the appearance of a right-angled 'C' with the open end of the 'C', the shim channel 80, facing forwards. The channel has an inner vertical surface 82 and a height larger than that of the nut 72. The shim also has an outer vertical back wall 84. Extending outward to the left from the top and bottom of the sliding shim, perpendicular to the shim body, are forwardly located upper and lower shim finger portions 86, 88.

Figure 5:
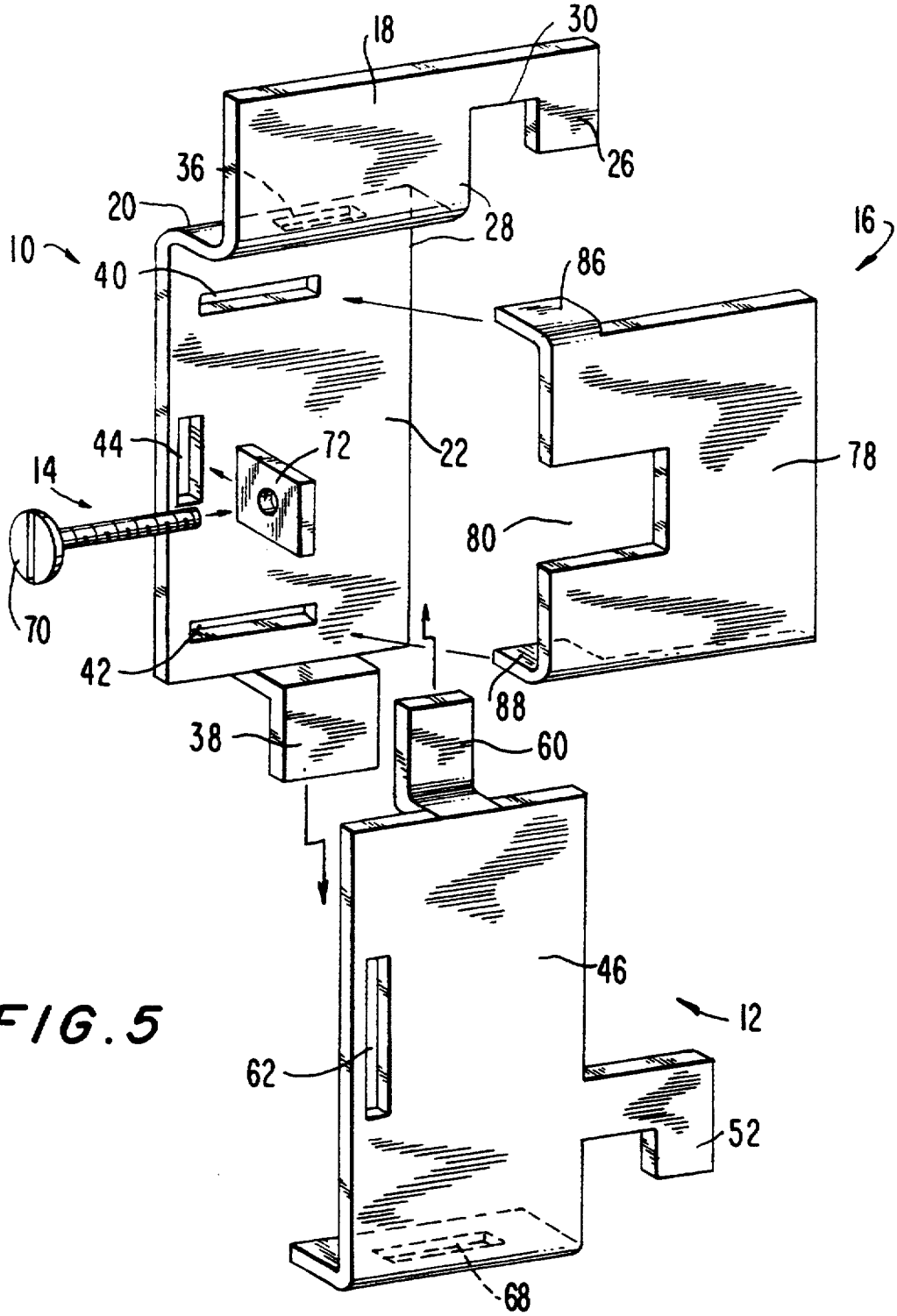
FIG. 5 is a right side exploded perspective view of the bracket prior to assembly.
Figure 6A:
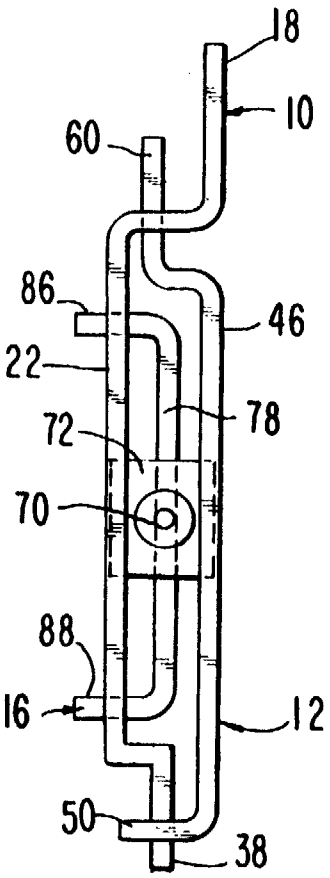
FIG. 6 is a view similar to FIG. 5 showing the locking assembly about to be placed in position in a nearly assembled bracket and illustrating the bracket's two dimensional movement.
Figure 6:
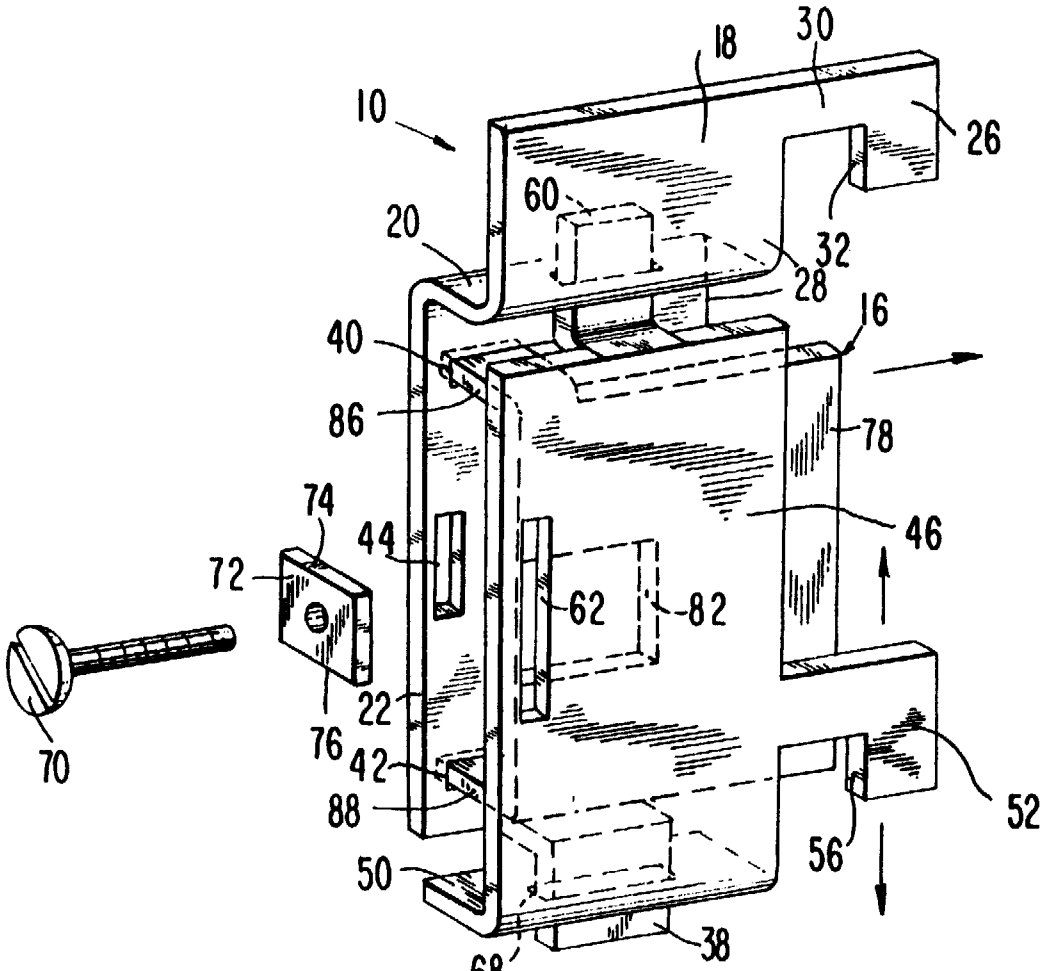

The bracket is assembled so that the sliding shim 16 is sandwiched between the fixed and sliding bracket members 10, 12 (FIGS. 5, 6). The upper and lower shim finger portions 86, 88 are inserted in the upper and lower fixed bracket horizontal guides 40, 42 so the shim body 78 is adjacent and parallel to the fixed bracket member lower vertical portion 22 . The fixed bracket upper and lower horizontal guides 40,42 have heights just larger than that of the upper and lower shim finger portions 86, 88 while the length of the guides is significantly longer than the front-to-back length of the finger portions. The guides are positioned so that each shim finger portion can be inserted in its corresponding horizontal guide, and the shim can move front to back when seated in the guides with minimal vertical movement. The vertical position and depth of the shim channel 80 is chosen so that when the shim is seated in the fixed bracket horizontal guides 40, 42, the channel is aligned with the fixed bracket vertical slot 44 and the slot is not covered by the shim body 78 at any point along the shim's full range of motion within the horizontal guides. The sliding and fixed bracket members 10,12 are fitted together by inserting the fixed bracket finger portion 38 into the sliding bracket finger guide 68 while simultaneously inserting the sliding bracket finger portion 60 into the fixed bracket finger slot 36. The bracket finger portions have sufficient vertical length to allow substantial vertical motion of the sliding bracket member 10 with respect to the fixed bracket member 12 without the bracket members disengaging. The bracket finger slots 36, 68 and bracket finger members 38, 60 are positioned on the bracket members so that when the bracket members are engaged, the fixed bracket vertical slot 44 and sliding bracket vertical guide 62 are aligned. The positions of the bracket finger slots 36, 68 and horizontal extensions of the bracket finger portions 38, 60 are chosen so that when the fixed and sliding bracket members are engaged, the fixed bracket upper vertical portion 18 and the sliding bracket body 46 and thus the fixed bracket tab 26 and sliding bracket tab 52 lie in the same plane (FIGS. 6, 6*a*). The rearward extension of the fixed bracket tab 26 and then sliding bracket tab 52 is chosen so that when the fixed and sliding bracket members are engaged, the fixed bracket tab inner vertical surface 32 and the sliding bracket tab inner vertical surface 56 lie along the same vertical axis.

Figure 6B:
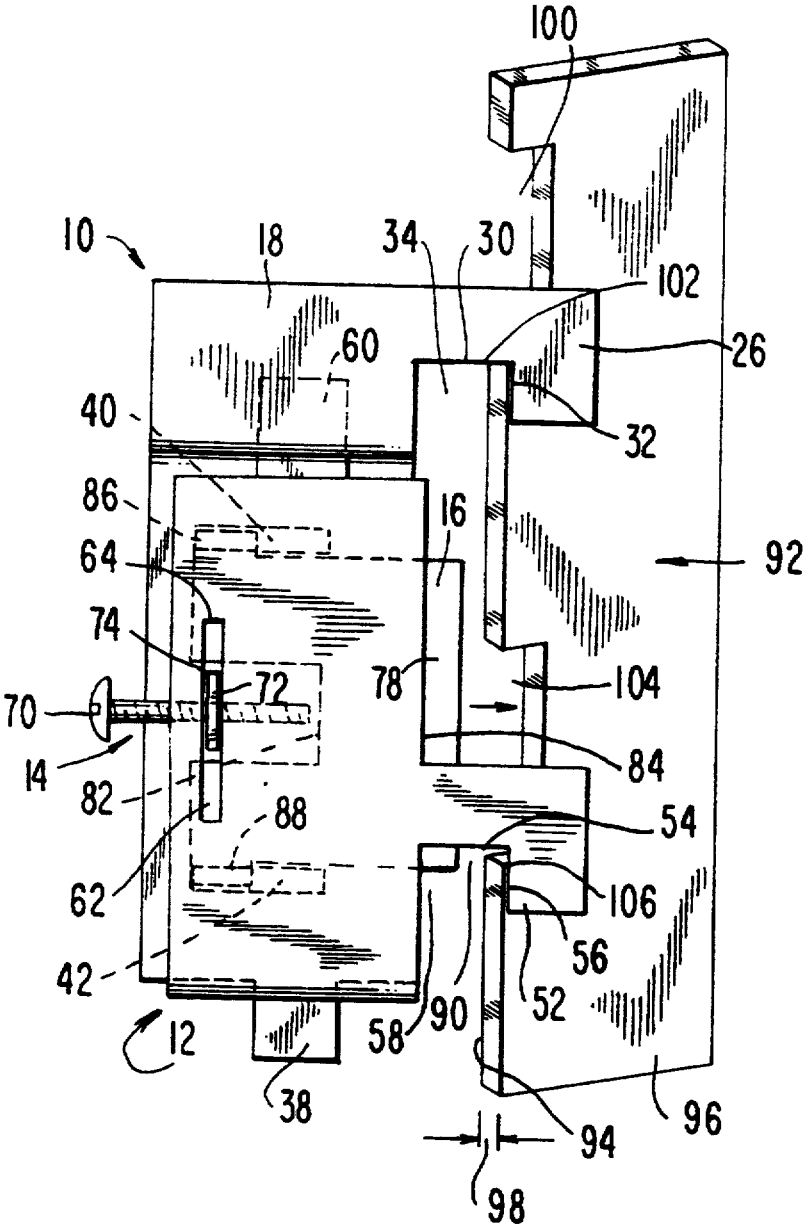

The rectangular nut 72 (FIGS. 5, 6*a*) is fitted snugly in the fixed bracket vertical slot 44 passing through the shim channel 80 and into the sliding bracket vertical guide 62. The nut is positioned so that a screw passing rearwardly through the nut will lie in the plane of the shim body 78 (FIG. 6*a*). The insertion of the screw 70 into the nut keeps the nut positioned between the two bracket members while the walls of the shim channel prevent the nut from rotating. The vertical length of the sliding bracket vertical guide 62 (FIG. 6*b*) is just short enough so that when the sliding bracket member 12 is moved downwards in relation to the fixed bracket member 10, the sliding bracket vertical guide upper inner surface 64 hits the nut's upper surface 74 just before the bracket members would disengage. The position of the screw 70 in the nut is used to limit how far forward within the horizontal guides 40, 42 the sliding shim 16 can travel. The sliding shim can move forward until the shim channel inner vertical surface 82 hits the tip of the screw. A downward opening adjustable channel 90 (FIG. 6*b*) is then defined by the outer vertical shim wall 84, the sliding bracket tab inner horizontal surface 54 and the sliding bracket tab inner vertical surface 56.

The assembled bracket (FIG. 6*b*) is secured to a vertical slotted wall 92 having a front surface 94, a back surface 96 and a thickness 98. The bracket is secured within a pair of vertically aligned slots in the wall—an upper slot 100 having inner bottom surface 102 and a lower slot 104 having inner bottom surface 106, both slots having a depth equal to the wall thickness.

The fixed bracket tab 26 is seated in the upper slot 100 so that the tab's inner horizontal surface 30 rest on the slot's bottom surface 102 and the tab's inner vertical surface 32 abuts the back of the vertical slotted wall 96. The upper tab is held in place via a cantilever force. The width of the fixed bracket channel 34 is substantially greater than the thickness of the vertical wall 98 allowing the tab to be easily seated and removed.

The sliding bracket member 12 is adjusted vertically with respect to the fixed bracket member 10 so that sliding bracket tab 52 engages the lower slot 104 and the sliding bracket tab's inner horizontal surface 54 rests on the slot's bottom surface 106. The width of the sliding bracket channel 58 is substantially greater than the thickness of the vertical wall 98. The depth of the adjustable channel 90 is reduced moving the sliding shim 16 back so the outer vertical shim wall 84 abuts the front surface of the vertical slotted wall 94 and the sliding bracket tab's inner vertical surface 56 abuts the back surface of the vertical slotted wall 96 forming a snug fit. The screw 70 is adjusted until the its end hits the shim channel inner vertical surface 82, holding the shim in position and locking the assembled universal upright bracket in place.

A left handed upright bracket can be constructed in a similar manner. The bracket member tabs would then lie along the plane of an outer wall formed by the left handed fixed bracket member's upper vertical portion 18' and the left handed sliding bracket member's body 46'. Left and right handed universal upright brackets can be placed side by side so that the fixed bracket member's upper vertical portions and the sliding bracket member's bodies are flush with each other and the left and right bracket's tabs are flush and aligned with each other. In this configuration, a left and right upright bracket can engaged a single pair of vertically aligned slots in a vertical slot wall.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An improved upright interface bracket for use with a variety of different point-of-sale elements in a display upright, the display upright having a vertical slotted wall, the upright interface bracket comprising:

(a) a fixed bracket member having top and bottom portions, a downwardly extending tab secured to the top portion defining a downwardly opening channel, and a downwardly extending finger secured to the bottom portion;

(b) a sliding bracket member having a body portion, with an upwardly extending finger secured to a top edge of the body portion and a downwardly extending tab secured to a lower rear edge of the body portion and defining a downwardly opening channel; means on the fixed bracket for vertically, slideably receiving the sliding bracket upper finger, means on the sliding bracket for vertically slideably receiving the fixed bracket lower finger;

(c) a sliding shim means, moveable in the horizontal direction, means in the fixed bracket for receiving the sliding shim, said sliding shim moveable within said receiving means a predetermined limited horizontal distance;

(d) locking assembly means for securing the fixed bracket, the sliding bracket, and the sliding shim means so that the tabs on the fixed and sliding brackets may be vertically positioned at a desired distance from each other, a horizontal adjustment of the sliding shim means varying the width of the sliding bracket tab channel so that when the tab assembly is placed within slots in an upright, the lower channel may be used to anchor the assembly securely within the slots in the vertical wall.

2. The invention according to claim 1 wherein the top and bottom portions of the fixed bracket are vertical and substantially rectangular with front and back surfaces, said top and bottom portions being connected via a horizontal portion, said horizontal portion being connected at the upper end of the bottom portion and the lower end of the upper portion, said horizontal portion having front and back surfaces and a centrally located slot running from front to back between the front and back surfaces.

3. The invention according to claim 2 wherein the fixed bracket member finger portion extends horizontally and perpendicularly outward and downward from a lower part of the bottom portion.

4. The invention according to claim 3 wherein the bottom portion of the fixed bracket member has upwardly and downwardly, centrally located horizontal guides placed between the front and back surfaces and a forwardly, centrally located vertical slot.

5. The invention according to claim 4 wherein the fixed bracket downwardly extending tab extends rearwardly and downwardly from a back surface of the top portion, said tab having inner vertical and horizontal surfaces; the back surface of the top portion and the inner vertical and horizontal tab surfaces defining a downwardly opening channel.

6. The invention according to claim 1 whereby the sliding bracket member body portion is substantially rectangular with front and back surfaces, the body portion being connected at a lower end to a foot portion, the body and foot portions being substantially perpendicular to each other.

7. The invention according to claim 6 wherein said means on the sliding bracket for vertically slideably receiving the fixed bracket lower finger is a centrally located slot running from front to back between front and back surfaces of the foot portion.

8. The invention according to claim 7 wherein the sliding bracket body portion has a forwardly, centrally located vertical guide.

9. The invention according claim 8 wherein said upwardly extending finger of the sliding bracket extends horizontally and perpendicularly inward and upward.

10. The invention according to claim 9 wherein said downwardly extending tab has an inner horizontal and vertical surface, the back surface of said sliding bracket top portion and the tab's inner vertical and horizontal surfaces forming the downwardly opening channel.

11. The invention according to claim 1 whereby the sliding shim is a vertical body with a back wall and shaped like a right-angled 'C', the open end of the 'C' facing forward and defining a channel with an inner vertical wall.

12. The invention according to claim 11 wherein the sliding shim has two forwardly located finger portions extending perpendicularly outward from sliding shim's top and bottom, said portions extending outward in the same direction.

13. The invention according to claim 1 wherein the locking assembly is comprised of a screw and rectangular nut, said nut having upper and lower surfaces.

14. An improved upright interface bracket for use with a variety of different point-of-sale elements in a display upright comprising (a) a fixed bracket member having three regions: an upper vertical portion bent outwardly perpendicular at its lower end, a middle horizontal portion secured to the upper portion's lower end, and a lower vertical portion secured at it's upper end to the middle horizontal portion;

(i) said upper vertical portion having an upper surface and a rearwardly downwardly extending tab with inner surfaces forming a downwardly opening channel;

(ii) said middle horizontal portion having a centrally located horizontal slot running from front to back;

(iii) a lower vertical portion having a finger portion extending outwards perpendicularly and downwards from its bottom, centrally located horizontal guides near its top and bottom, and a forwardly, centrally located vertical slot;

(b) a sliding bracket member having a vertical rectangular body and a connected horizontal foot;

(i) the vertical rectangular body having a rearwardly, downwardly extending tab with inner surfaces that form a downwardly opening channel, a finger portion extending perpendicularly outwards and upwards from its top, and a forwardly centrally located vertical guide;

(ii) the horizontal foot having a centrally located slot running from front to back;

(c) a sliding shim being a vertical body with a back wall and shaped like a right angled 'C' the open end of the 'C' facing forwards and defining a channel with an inner vertical wall, the shim having forwardly located finger portions extending perpendicularly outward from the top and bottom;

(d) a locking assembly being composed of a screw and rectangular nut;

the bracket components having dimensions and interlocking so that:

(a) the sliding shim is seated in the fixed bracket, the shim fingers fitting into the horizontal guides so the shim can move from front to back within the guides without moving vertically, the shim channel being aligned with the fixed bracket vertical slot and deep enough to prevent the slot from being covered at any point along the shim's range of motion;

(b) the fixed bracket finger fits into the sliding bracket foot portion slot and the sliding bracket finger fits into the fixed bracket horizontal portion slot, the sliding shim being sandwiched between the fixed and sliding bracket members, the finger portions being long enough to allow substantial vertical motion of the sliding bracket with respect to the fixed bracket without disengagement;

(c) the rectangular nut fits snugly in the fixed bracket vertical slot being aligned so that the screw passing rearwardly through the nut is in line with the inner vertical wall of the shim channel, the nut passing through the shim channel and the sliding bracket vertical guide, the sliding bracket vertical guide being just short enough so that its upper inner wall hits the nut before the sliding bracket member would disengage from the fixed bracket member, the shim channel being narrow enough to prevent the nut from rotating;

the assembled bracket being secured to a pair of vertically aligned slots in a vertical wall where:

(a) the fixed bracket channel is substantially wider than the depth of the vertical wall allowing the tab to be easily seated in a slot and removed, the tab being held in place via a cantilever force;

(b) the sliding bracket is vertically adjusted with respect to the fixed bracket so that the sliding bracket tab can be seated in a slot below the one the fixed bracket tab is seated in, the channel of the sliding bracket tab being substantially wider then the width of the vertical wall, the outer wall of the sliding shim along with the horizontal and vertical inner surfaces of the sliding bracket tab forming an adjustable channel, the shim being moved back reducing the size of the adjustable channel so the sliding bracket tab fits snugly in a slot in the vertical wall, the sliding shim being held in place with the screw from the locking assembly.

15. An improved upright interface bracket for use with a variety of different point of sale elements in a display upright having a vertical slotted wall, the upright interface bracket comprising:

a fixed bracket member having top and bottom portions, and a downwardly-extending tab secured to the top portion defining a downward extending channel;

a sliding bracket member having a body portion, a downwardly-extending tab secured to a lower rear of the body portion and defining a downwardly-opening channel;

means on said fixed and sliding bracket members for inter-engaging the brackets for limited relative vertical positioning therebetween while simultaneously creating a shim-accepting space between said fixed and sliding bracket members;

a sliding shim means having a forwardly-directed surface located within said shim-accepting space and movable in the horizontal direction to define, with said sliding bracket member tab, a variable width tab channel engageable with an edge of a vertical wall slot, said fixed bracket having means for limiting the extent of possible horizontal travel of said shim; and locking assembly means for securing the fixed bracket, the sliding bracket, and the sliding shim in a manner for vertically positioning said tabs on the fixed and sliding brackets a desired distance from each other and for urging said sliding shim means in a horizontal direction against the display upright to narrow the tab channel to anchor the assembly securely within the engaged slot of the vertical slotted wall.

16. The bracket of claim 15, wherein said locking assembly means comprise a nut supported by said fixed and sliding brackets and a mating screw having an end surface bearing against an edge of said sliding shim.

* * * * *